US007175108B2

(12) United States Patent
Saine

(10) Patent No.: US 7,175,108 B2
(45) Date of Patent: Feb. 13, 2007

(54) APPLICATOR AND NOZZLE FOR DISPENSING CONTROLLED PATTERNS OF LIQUID MATERIAL

(75) Inventor: Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 189 days.

(21) Appl. No.: 10/510,551

(22) PCT Filed: Apr. 11, 2003

(86) PCT No.: PCT/US03/11056

§ 371 (c)(1),
(2), (4) Date: Oct. 7, 2004

(87) PCT Pub. No.: WO03/086949

PCT Pub. Date: Oct. 23, 2003

(65) Prior Publication Data

US 2005/0167529 A1 Aug. 4, 2005

(51) Int. Cl.
*B05B 1/28* (2006.01)

(52) U.S. Cl. ..... 239/290; 239/296; 239/298; 239/399; 239/406; 239/417.3; 239/424; 239/549; 239/600; 239/583

(58) Field of Classification Search ..... 239/290, 239/296, 298, 398, 399, 403, 405, 406, 407, 239/417.3, 422, 423, 424, 600
See application file for complete search history.

(56) References Cited

U.S. PATENT DOCUMENTS 2,401,503 A 6/1946 Paasche
2,929,566 A 3/1960 Paasche
3,066,874 A 12/1962 Becker (Continued)

FOREIGN PATENT DOCUMENTS

EP 0792744 A2 3/1997

(Continued)

OTHER PUBLICATIONS

Syang-Peng Rwei, *Dog-Legging in the Melt Spinning Process*, Polymer Engineering and Science, vol. 38, No. 2, pp. 341-347, Feb. 1998.

(Continued)

*Primary Examiner*—Dinh Q. Nguyen
(74) *Attorney, Agent, or Firm*—Wood, Herron & Evans, L.L.P.

(57) ABSTRACT

An apparatus (10) for dispensing a filament of liquid includes a nozzle (12) having a liquid discharge passage (46) and a plurality of air discharge passages (70, 72, 74, 76). The liquid discharge passage (46) extends centrally through a frustoconical protrusion (89) which is located in a recess (88). The air discharge passages (70, 72, 74, 76) are arranged in a pattern around the liquid discharge passage (46) at the base of the protrusion (89) within the recess (88). The air discharge passages (70, 72, 74, 76) have axes (70*a*, 72*a*, 74*a*, 76*a*) which are inclined such that jets of air from the air discharge passages (70, 72, 74, 76) are tangential to the filament (13) dispensed from the liquid discharge passage (46). The jets of air cause the filament (13) to move in a swirl pattern as it is deposited on a substrate (18).

10 Claims, 4 Drawing Sheets

U.S. PATENT DOCUMENTS

| | | | | |
|---|---|---|---|---|
| 3,168,250 | A | | 2/1965 | Paasche |
| 3,814,328 | A | | 6/1974 | Warning |
| 4,031,854 | A | | 6/1977 | Sprague, Jr. |
| 4,135,903 | A | | 1/1979 | Ohsato et al. |
| 4,185,981 | A | | 1/1980 | Ohsato et al. |
| 4,785,996 | A | | 11/1988 | Ziecker et al. |
| 4,815,660 | A | | 3/1989 | Boger |
| 4,844,003 | A | | 7/1989 | Slautterback et al. |
| 4,969,602 | A | | 11/1990 | Scholl |
| RE33,481 | E | | 12/1990 | Ziecker et al. |
| 4,983,109 | A | | 1/1991 | Miller et al. |
| 5,065,943 | A | | 11/1991 | Boger et al. |
| 5,145,689 | A | * | 9/1992 | Allen et al. ..... 425/72.2 |
| 5,169,071 | A | | 12/1992 | Boger et al. |
| 5,171,512 | A | | 12/1992 | Mende et al. |
| 5,194,115 | A | | 3/1993 | Ramspeck et al. |
| 5,267,693 | A | | 12/1993 | Dickey |
| 5,342,647 | A | | 8/1994 | Heindel et al. |
| 5,553,758 | A | | 9/1996 | Melendy et al. |
| 5,645,220 | A | | 7/1997 | Hohndord |
| 5,785,258 | A | | 7/1998 | Akin et al. |
| 5,882,573 | A | | 3/1999 | Kwok et al. |
| 5,902,540 | A | | 5/1999 | Kwok |
| 5,904,298 | A | | 5/1999 | Kwok et al. |
| 5,921,476 | A | | 7/1999 | Akin et al. |
| 6,149,076 | A | | 11/2000 | Riney |
| 6,170,759 | B1 | * | 1/2001 | Meyer ..... 239/298 |
| 6,210,141 | B1 | | 4/2001 | Allen |
| 6,250,357 | B1 | | 6/2001 | Niedermeyer |
| 6,308,864 | B1 | | 10/2001 | Messer |
| 6,311,899 | B1 | | 11/2001 | Hidaka et al. |
| 6,322,630 | B1 | | 11/2001 | Carroll et al. |
| 6,361,634 | B1 | | 3/2002 | White et al. |
| 6,435,425 | B1 | | 8/2002 | Saidman |
| 6,676,038 | B2 | * | 1/2004 | Gressett et al. ..... 239/296 |

FOREIGN PATENT DOCUMENTS

| | | | |
|---|---|---|---|
| EP | 0936000 | | 8/1999 |
| EP | 1155745 | A2 | 11/2001 |
| JP | 11244774 | A | 9/1999 |
| JP | 2001259497 | | 9/2001 |
| WO | 99/59732 | | 11/1999 |
| WO | 03/024608 | | 3/2003 |

OTHER PUBLICATIONS

J&M Laboratories, *Durastitch™ Technology*, New Product Release Manual, Feb. 1997.

Rajiv S. Rao et al., *Vibration and Stability in the Melt Blowing Process*, Ind. Eng. Chem., 32, pp. 3100-3111, 1993.

* cited by examiner

APPLICATOR AND NOZZLE FOR DISPENSING CONTROLLED PATTERNS OF LIQUID MATERIAL

FIELD OF THE INVENTION

The present invention generally relates to a liquid material dispensing apparatus and nozzle and, more specifically, to an apparatus and nozzle for dispensing controlled patterns of liquid adhesive strands or filaments.

BACKGROUND OF THE INVENTION

Many reasons exist for dispensing liquid adhesives, such as hot melt adhesives, in the form of a thin filament or strand with a controlled pattern. Conventional patterns used in the past have been patterns involving a swirling effect of the filament by impacting the filament with a plurality of jets of air. This is generally known as controlled fiberization or CF® in the hot melt adhesive dispensing industry. Controlled Fiberization techniques are especially useful for accurately covering a wider region of a substrate with adhesive dispensed as single filaments or as multiple side-by-side filaments from nozzle passages having small diameters, such as on the order of 0.010 inch to 0.060 inch. The width of the adhesive pattern placed on the substrate can be widened to many times the width of the adhesive filament itself. Moreover, controlled fiberization techniques are used to provide better control of the adhesive placement. This is especially useful at the edges of a substrate and on very narrow substrates, for example, such as on strands of material such as spandex, commonly sold under the trademark LYCRA, used in the leg bands of diapers. Other adhesive filament dispensing techniques and apparatus have been used for producing an oscillating pattern of adhesive on a substrate or, in other words, a stitching pattern in which the adhesive moves back-and-forth generally in a zig-zag form on the substrate. These dispensers or applicators have a series of liquid and air orifices arranged on the same plane.

Conventional swirl nozzles or die tips typically have a central adhesive discharge passage surrounded by a plurality of air passages. The adhesive discharge passage is centrally located on a protrusion which is symmetrical in a full circle or radially about the adhesive discharge passage. A common configuration for the protrusion is conical or frustoconical with the adhesive discharge passage exiting at the apex. The air passages are typically positioned at the base of the protrusion. The air passages are arranged in a radially symmetric pattern about the central adhesive discharge passage, as in the protrusion itself. The air passages are directed in a generally tangential manner relative to the adhesive discharge passage and are all angled in a clockwise or counterclockwise direction around the central adhesive discharge passage.

Conventional meltblown adhesive dispensing apparatus typically comprises a die tip having multiple adhesive or liquid discharge passages disposed along an apex of a wedge-shaped member and air passages of any shape disposed along the base of the wedge-shaped member. The wedge-shaped member is not a radially symmetric element. Rather, it is typically elongated in length relative to width. The air is directed from the air discharge passages generally along the side surfaces of the wedge-shaped member toward the apex and the air impacts the adhesive or other liquid material as it discharges from the liquid discharge passages to draw down and attenuate the filaments. The filaments are discharged in a generally random manner.

SUMMARY OF THE INVENTION

The present invention provides a meltblown style applicator with the capability of producing a controlled swirling of the liquid filament. This results in repeatable filament orientation with improved edge control. Further, the invention provides a predictable relationship between a specific geometric configuration of liquid and air discharge passages and the resulting pattern width and frequency. Thus, the nozzle configuration can be controlled to give a tighter, high frequency filament pattern, a more open, lower frequency filament pattern, or an expanded pattern with crossover points of the filament being spaced further apart than in a conventional swirl pattern.

The present invention generally provides a liquid dispensing module or applicator for discharging at least one liquid filament onto a moving substrate with a swirl pattern. The dispensing module includes a dispenser or module body for receiving pressurized liquid and air and a nozzle is coupled to the module body. The nozzle comprises a nozzle body having a first side and a second side with the first side coupled to the module body and including a liquid supply port and an air supply port coupled with respective liquid and air supply passages of the module body. In the preferred embodiment, the first and second sides are respectively located on parallel planes of the nozzle body, but other configurations may be used as well. A protrusion is located on the second side of the nozzle body and includes a base, an apex and a side surface converging toward the apex. A liquid discharge passage extends along an axis through the apex of the protrusion and the protrusion is positioned centrally within a recess. The liquid discharge passage communicates with the liquid supply port of the nozzle body. The protrusion extends in a radially symmetrical manner around the liquid discharge passage. The nozzle body further includes a plurality of process air discharge passages positioned adjacent the base of the protrusion within the recess. Each of the air discharge passages is angled in a direction generally toward the liquid discharge passage. Each air discharge passage is also offset from the axis of the liquid discharge passage.

In the preferred embodiment, the nozzle body includes four of the air discharge passages positioned in a generally square pattern about the liquid discharge passage. However, more or less air discharge passages may be used, as well as different position configurations. In the preferred embodiment, each of the air discharge passages is offset by the same distance from the axis of the liquid discharge passage. The air discharge passages positioned at diagonally opposed corners of the square pattern are symmetrically positioned relative to the liquid discharge passage. Each of the air discharge passages is offset from the axis of the liquid discharge passage by a distance at least equal to the radius of the liquid discharge passage. The frustoconical protrusion is preferably formed integrally with the nozzle body, such as through machining or cold forming techniques. Especially when dispensing hot melt adhesive materials, the liquid discharge passage has a diameter of between about 0.010 inch and about 0.060 inch and the air discharge passages are each offset from the axis of the liquid discharge passage by a minimum distance of about 0.005 inch to about 0.030 inch up to a maximum of about 0.060 inch.

The inventive concepts apply to dispensing modules having one or more sets of liquid and air discharge passages. For many applications, it will be desirable to provide a nozzle having multiple side-by-side sets of liquid and air discharge passages with each set configured as described above. Each set may be designed to achieve the same filament pattern or one or more sets may be configured to produce a different pattern, such as a pattern with a larger or smaller width of adhesive coverage. Each set may be arranged with respect to a separate protrusion. In each case, a desirable liquid filament pattern can be achieved and, moreover, due to the unique configuration of air and liquid discharge passages around the associated protrusion, a nearly linear relationship exists between the offset dimension, which is defined between the air discharge passages and the axis of the liquid discharge passage, and the resulting pattern width and frequency. As a result, different configurations of the air and liquid discharge passage may be made with precisely predictable results in terms of both swirled pattern width perpendicular to the substrate movement and oscillation frequency parallel to the movement of the substrate of the swirled pattern.

These and other features, objects and advantages of the invention will become more readily apparent to those of ordinary skill in the art upon review of the following detailed description, taken in conjunction with the accompanying drawings.

DETAILED DESCRIPTION OF PREFERRED EMBODIMENTS

For purposes of this description, words of direction such as "upward", "vertical", "horizontal", "right", "left" and the like are applied in conjunction with the drawings for purposes of clarity in the present description only. As is well known, liquid dispensing devices may be oriented in substantially any orientation, so these directional words should not be used to imply any particular absolute directions for an apparatus consistent with the invention.

Figure 1:
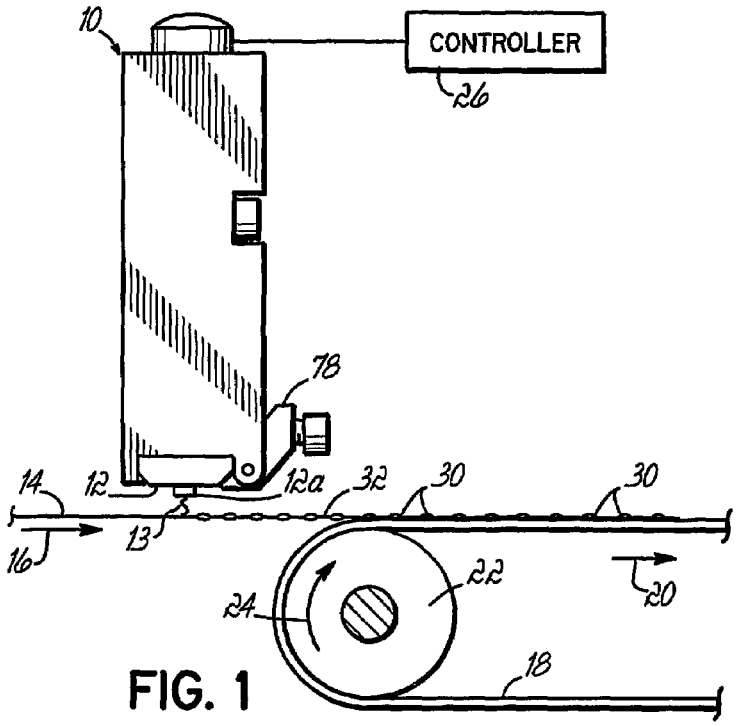
FIG. 1 is a schematic side elevational view of a manufacturing system for an article constructed in accordance with the invention.

FIG. 1 illustrates one embodiment of the method of this invention which uses an adhesive dispenser or module 10 including a nozzle 12. Nozzle 12 may include a circular adhesive discharge orifice, a more elongate slot-shaped orifice, or other types of orifices suitable for dispensing continuous adhesive filaments 13 of a desired width and with a pattern as discussed in greater detail below. In this embodiment, one or more stretched elastic LYCRA strands 14 are moving in the direction of arrow 16 and a flat sheet 18 of substrate material, such as a woven or non-woven material, is moving in the direction of arrow 20 around a conventional guide cylinder 22 rotating in the direction of arrow 24. Strand 14 is stretched so that, upon attachment to sheet 18, the sheet 18 will be elasticized generally along a line defined by strand 14. Dispenser or module 10 is operated by a suitable controller 26 for actuating a valve (not shown) within the dispenser 10. Other types of dispensers may be used as well. The apex or tip 12*a* of the nozzle 12 is spaced a short distance from the LYCRA strand 14 and accurately dispenses adhesive filaments 13 onto the strand 14 immediately prior to or upstream from the point 32 where the strand 14 meets the substrate 18. As discussed below, the filament 13 is discharged in a pattern that may form discrete areas of adhesive such as solid dots 30 of adhesive that may or may not be connected by thinner filament sections. During the time that it takes for the strand 14 to reach point 32, the adhesive will flow or wrap preferably around all sides of the strand 14 including the lower side (as viewed in FIG. 1) to ensure full bonding between the strand 14 and the upper surface of the substrate 18.

Dispenser 10 may be constructed in accordance with the dispenser described in copending U.S. patent application Ser. No. 09/999,244, the disclosure of which is fully incorporated by reference herein. Dispenser 10 uses pressurized air to move a filament of adhesive back and forth in accordance with the inventive principles. It will be appreciated that other types of dispensers may be used instead, including those that use pressurized process air or other manners of moving a filament of adhesive after discharge. For example, electrostatic technology can be used to move a filament of adhesive in manners suitable for use in carrying out the invention. Furthermore, while use of the dispenser 10 and nozzle 12 has been described above with respect to dispensing an adhesive filament onto and elastic strand, it will be recognized that the present invention may be used to dispense liquid material for other types of applications, including, but not limited to, laminating and constructing applications.

Figure 1A:
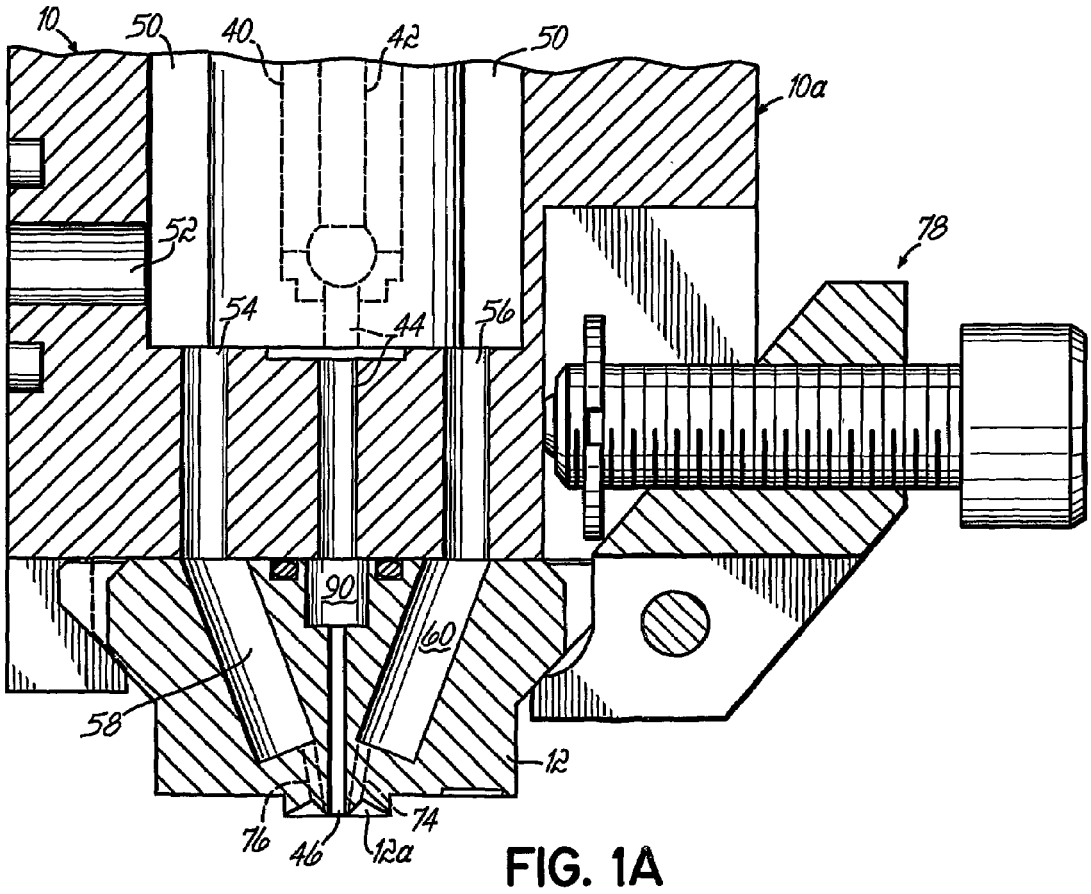
FIG. 1A is a fragmented cross-sectional view of the dispensing portion of a module including one nozzle or die tip configured to dispense an adhesive filament in accordance with a preferred embodiment of the invention.
Figure 2:
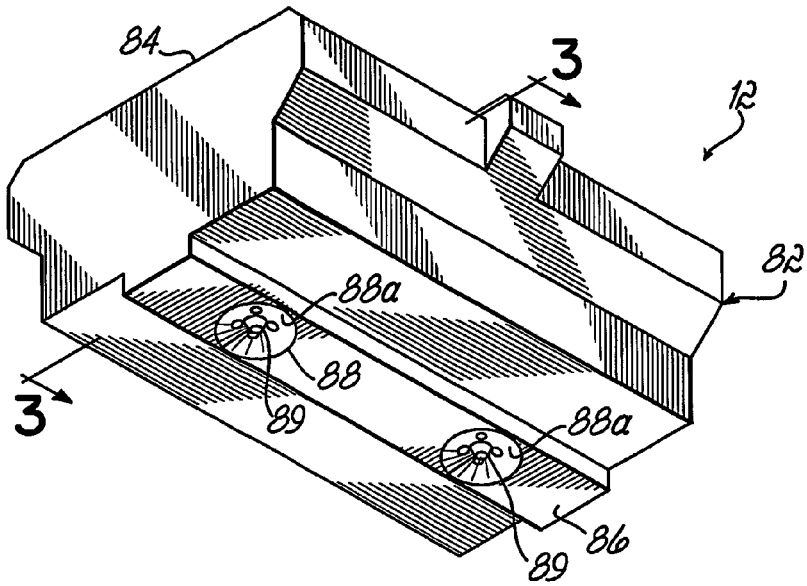
FIG. 2 is a perspective view of the nozzle or die tip of FIG. 1.

Referring to FIGS. 1A and 2, nozzle or die tip 12 is secured to a lower discharge portion 10*a* of module 10. Discharge portion 10*a* includes an internal cavity 40 including a valve mechanism 42 which reciprocates to open and close a discharge passage 44 allowing and preventing the flow of adhesive from cavity 40 to discharge passage 44. Discharge passage 44 is in fluid communication with a discharge orifice 46 of nozzle or die tip 12 for selectively discharging an adhesive filament 13 (FIG. 1) in accordance with the invention. An annular passage or cavity 50 within the discharge end 10*a* of module 10 receives pressurized process air from an input port 52. This air is communicated to passages 54, 56 which in turn communicate the air to supply passages 58, 60 within nozzle or die tip 12 and finally to four separate process air discharge passages 70, 72, 74, 76 (FIG. 5) surrounding each adhesive discharge passage. A clamp assembly 78 is used to secure nozzle or die tip 12 to module 10 as described in greater detail in the above-referenced patent application Ser. No. 09/999,244.

Referring first to FIGS. 2A and 3–6, a nozzle 12 is shown constructed in accordance with the preferred embodiment. Nozzle 12 includes a body 82 preferably formed from a metal, such as brass, and having an upper surface 84 and a lower surface 86. A conically-shaped recess 88 is formed into lower surface 86 and is generally defined by converging side surface 88*a*. A frustoconical protrusion 89 extends centrally from the recess 88. Preferably, the protrusion 89 does not extend out of the recess 88. This helps protect the protrusion 89 from damage. Air discharge passages 70, 72, 74, 76 extend approximately perpendicular to surface 88*a*. This helps facilitate easier drilling of the passages 70, 72, 74, 76. Upper surface 84 is adapted to be secured against the lower face of dispenser 10 and receives liquid material, such as hot melt adhesive, through a liquid inlet recess 90. Recess 90 further communicates with respective liquid discharge passages or orifices 46 having axes 46*a* extending through frustoconical protrusion 89. As mentioned above, air supply passages 58, 60 communicate with four air discharge passages 70, 72, 74, 76 extending along respective axis 70*a*, 72*a*, 74*a*, 76*a*.

Figure 3:
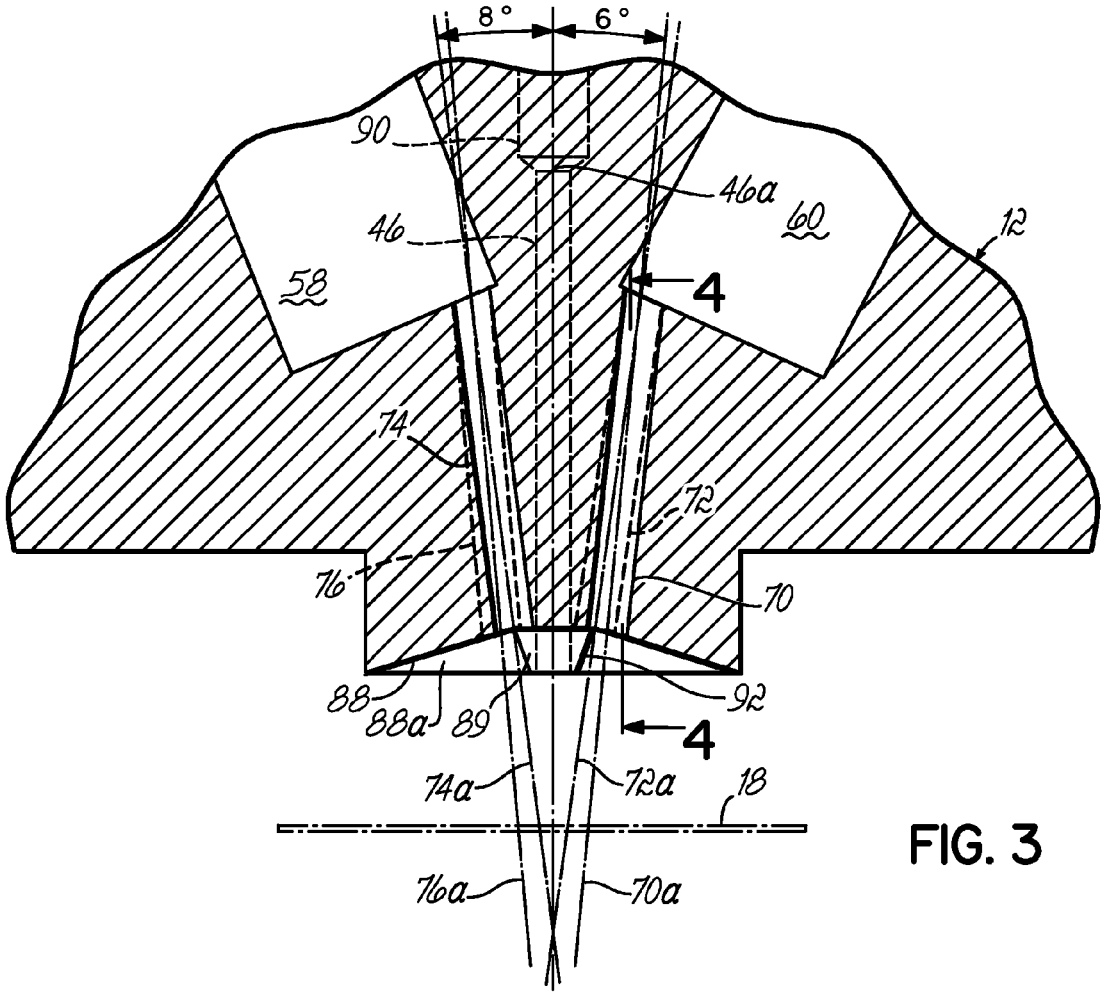
FIG. 3 is a cross-sectional view of the nozzle or die tip taken along line 3—3 of FIG. 2.
Figure 4:
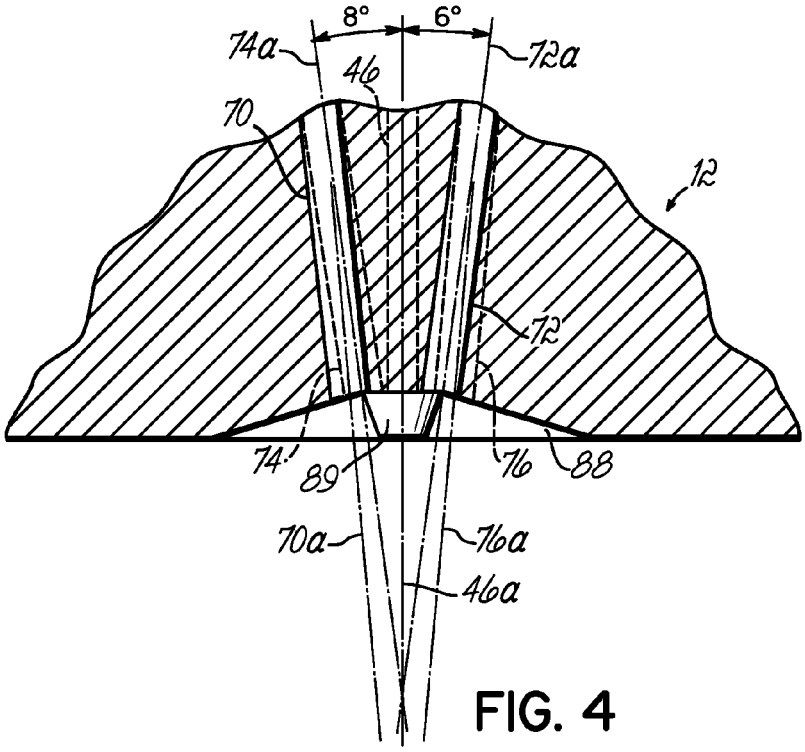
FIG. 4 is a cross-sectional view of the nozzle or die tip taken along line 4—4 of FIG. 3.

Frustoconical protrusion 89 has a side surface 92. Side surface 92 angles toward the apex of the frustoconical protrusion 89 such that the apex of the frustoconical protrusion 89 and the discharge outlet 46*b* of liquid discharge passage 46 is disposed generally at or above the lowest of lower surface 86 as shown in FIG. 3. Air discharge passages 70, 72, 74, 76 exit on lower surface 86 adjacent the base of frustoconical protrusion 89 as best shown in FIG. 3. Air discharge passages 70, 72, 74, 76 therefore discharge pressurized air generally along surface 88*a* with an angle as best comprehended by reviewing FIGS. 3–5.

Figure 2A:
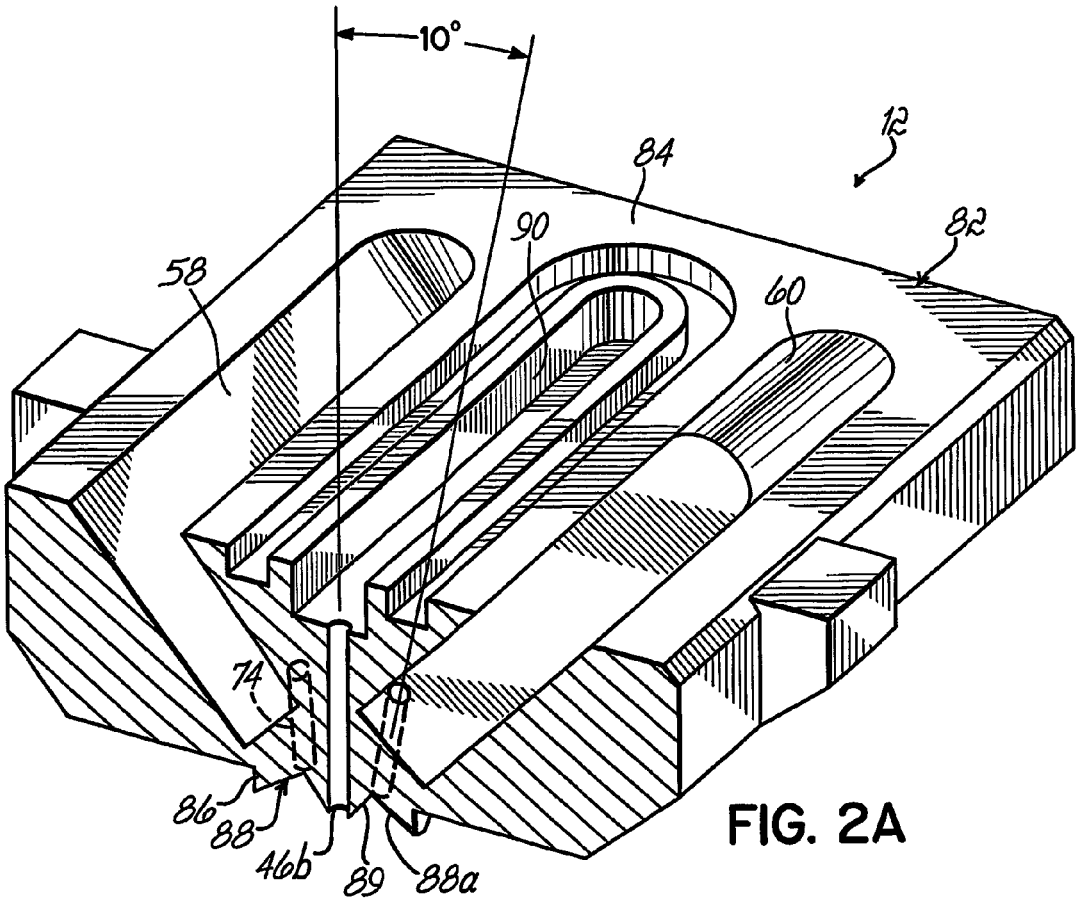
FIG. 2A is a perspective view of the nozzle or die tip shown in FIG. 1 sectioned through one of the adhesive discharge orifices.
Figure 5:
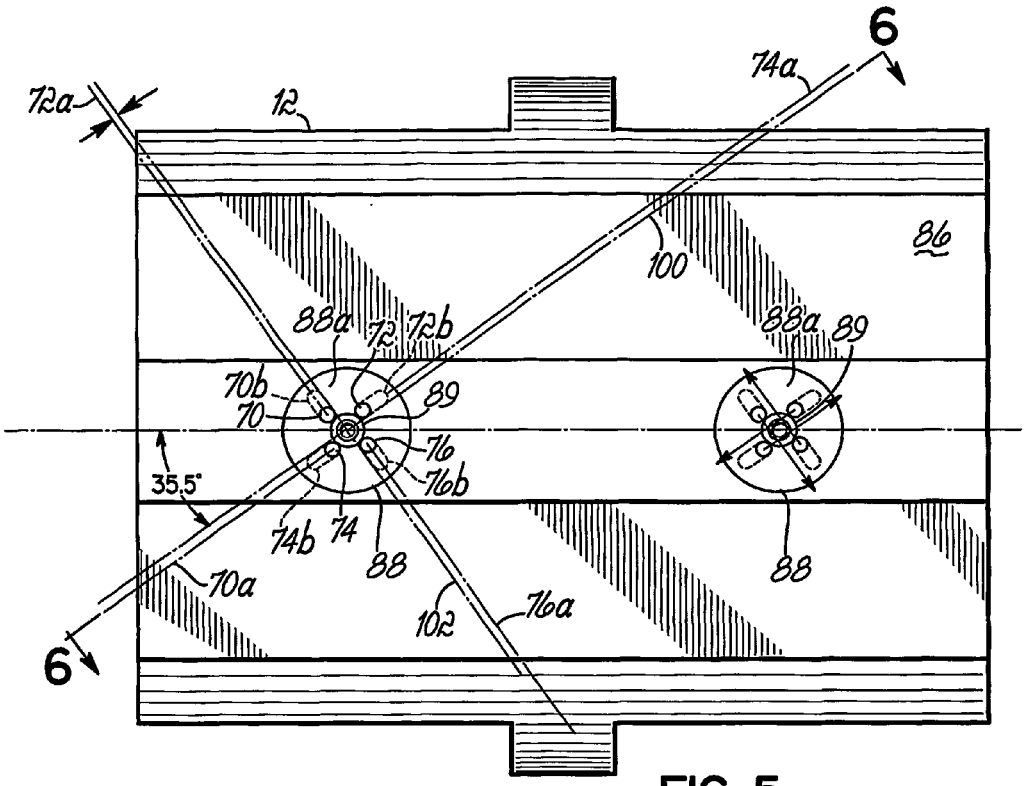
FIG. 5 is a bottom view of the nozzle or die tip of FIG. 1.
Figure 6:
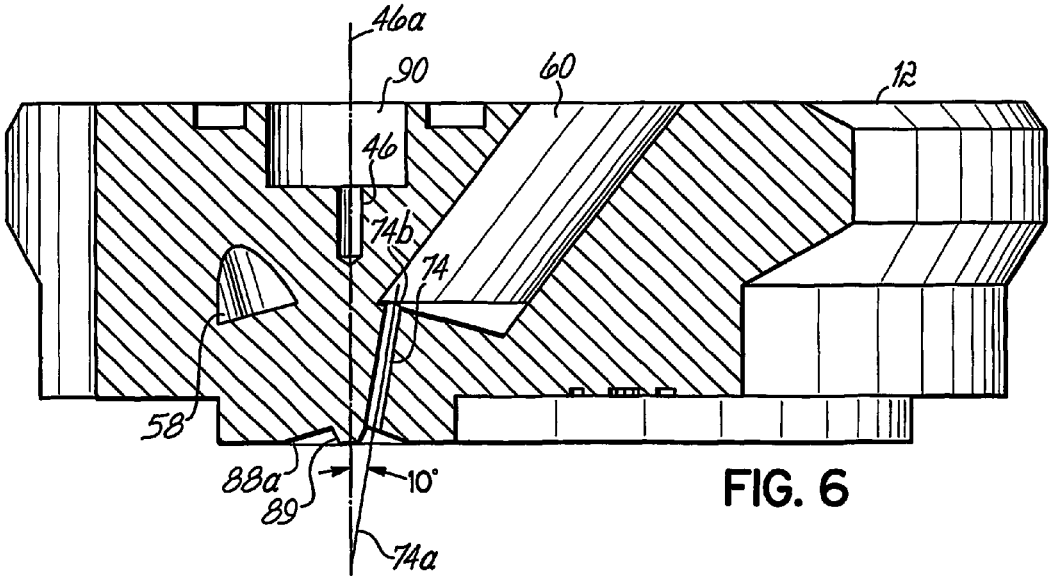
FIG. 6 is a cross-sectional view taken along line 6—6 of FIG. 5.

As viewed in section from the side of nozzle body 82 (FIG. 3), the axes 70*a*, 74*a* of air discharge passages 70, 74 are disposed preferably at about 8° and 6°, respectively, from the axis 46*a* of liquid discharge passage 46. The axis 72*a*, 76*a* of passages 72, 76 are preferably disposed at about 6° and 8°, respectively, from axis 46*a*. As viewed in section from the front (FIG. 4), axes 70*a*, 74*a* are at about 6° and 8°, respectively, relative to axis 46*a* and axes 72*a*, 76*a* are at about 8° and 6°, respectively, relative to axis 46*a*. This difference in the angles as viewed from the sides and the front is due to the presence of an offset of the axis of each generally diametrically opposed air discharge passage 72, 76 and 70, 74 as shown in FIG. 5. The true angle of each air discharge passage 70, 72, 74, 76 relative to axis 46*a* in the preferred embodiment is about 10° as shown in FIGS. 2A and 6. In accordance with the invention, the axes 70*a*, 74*a* of respective air discharge passages 70, 74 are offset in opposite directions relative to an axis 100 which is normal to axis 46*a* as shown in FIG. 5. In the preferred embodiment, each axis 70*a*, 74*a* is offset by the same dimension from axis 100. When passages 46, 70, 72, 74, 76 have diameters in the range of 0.010 inch to 0.020 inch as is typical in the hot melt adhesive dispensing industry, for example, the minimum offset dimension is preferably about 0.005 inch. In the preferred embodiment, liquid discharge passage 46 has a diameter of 0.018 inch, as do process air discharge passages 70, 72, 74, 76. The offset dimension of each air discharge passages 70, 72, 74, 76 with respect to axis 46*a* is 0.009 inch. Axes 72*a*, 76*a* are offset relative to an axis 102 to extending normal to axis 46*a* preferably by the same distance as axes 70*a*, 74*a* are offset from axis 46*a* as better illustrated by referring to axis 100 which is normal or perpendicular to axis 46*a* and parallel to axes 70*a*, 74*a*. However, it is also contemplated that different offset dimensions may be utilized between the various axes. For example, the offset dimensions between axes 70*a*, 74*a* and axis 100 may equal each other but may not equal the offset dimensions between axes 72*a*, 76*a* and axis 102. In other words, the offsets between axes 72*a*, 76*a* and axis 102 may equal each other but be smaller or larger than the offsets between axes 70*a*, 74*a* and axis 100.

In an exemplary embodiment, the line speed of the elastic strand(s) 14 and flat substrate 18 is in the range of 150–300 meters/minute. The process air pressure is in the range of 3–15 psi and the add-on rate of adhesive to the strand 14 is in the range of 10–50 mg/m/strand. A standard pressure sensitive hot melt adhesive may be used having a viscosity of about 5000–6000 cps. The discharge outlet 46*b* may be placed about ¼" from the strand 14. It will be recognized that many other set-ups for line speed, air pressure, and add-on rate are possible using the dispenser and nozzle of the present invention to create a broad range of patterns for various applications, as may be desired.

The four air discharge passages 70, 72, 74, 76 form a generally square pattern around the liquid discharge passage 46 at the base of the frustoconical protrusion 89. Diagonally opposite air discharge passages or, in other words, air discharge passages disposed at opposite corners of the square-shaped pattern are symmetric and disposed in planes that are at least nearly parallel to each other. Air discharge passages 72, 76 and 70, 74, respectively, are each offset in the equal manner described above with respective axis 100, 102 such that the air stream discharged from each air discharge passage 70, 72, 74, 76 is tangential to the liquid filament discharging from passage 46, as opposed to directly impacting the filament discharging from passage 46. The larger the offset between axis 70*a*, 74*a* and axis 100, and between axis 72*a*, 76*a* and axis 102, the larger or more open is the liquid swirl pattern created. Preferred minimum offset is equal to the radius of any air discharge passages 70, 72, 74, 76. Preferably, the offset dimensions of the respective pairs of air discharge passages 70, 74 and 72, 76 are also equal. As seen from viewing FIGS. 2A and 5, the inlets 70*b*, 72*b*, 74*b*, 76*b* of passages 70, 72, 74, 76 enter respective supply passages 58, 60 at similar locations along walls of passages 58, 60. This results from the 35.5° shown in FIG. 5, which is the same for each passage 70, 72, 74, 76. In addition, passages 70, 72, 74, 76 are each of similar length. These factors help ensure more uniform, balanced air flow from passages 70, 72, 74, 76. Also, the use of a cone-shaped, symmetrical protrusion in conjunction with the closely associated air passages 70, 72, 74, 76 provides low interference with the discharged air streams.

The configuration described above facilitates dispensing the liquid filaments in a generally circular swirl pattern. It will be recognized that one or more of the parameters described above may be modified to obtain various other patterns of the liquid filaments. It will also be recognized that, while the exemplary embodiment has been described above with respect to a nozzle having one liquid discharge passage extending through a frustoconical protrusion, the nozzle may alternatively have multiple liquid discharge passages extending through respective frustoconical protrusions. For example, the nozzle may have two liquid discharge passages, as depicted in FIGS. 2 and 5, each extending through a frustoconical protrusion and having associated air discharge passages. Alternatively, a nozzle may have 3, 4, 5, 6, or even more liquid discharge passages.

A number of factors contribute to the improved results of the invention. Generally, these relate to the movement of the adhesive filament in the air prior to reaching the elastic strand. Although the movement is a crossing pattern in the form of an expanded swirl pattern in the preferred embodiment, other crossing patterns or non-crossing patterns may be used to achieve the inventive principles. For example, a non-crossing vacillating or generally sinusoidal pattern may be used in place of an expanded swirl pattern. To achieve the best results with either of these general types of patterns, the width of the pattern transverse to the machine direction must be narrow enough to maintain control of the filament on the elastic strand. That is, the filament pattern should not be so wide as to hang considerably off the elastic strand. In this manner, distinct adhesive masses may be formed rather than a more uniform and excessive coating of the elastic strand. Also, the adhesive filament should have a component of movement, such as a swirling or vacillating movement, which is in the machine direction and an alternating component of movement which is opposite to the machine direction. The adhesive filament movement in the machine direction causes a momentary build-up of adhesive on the elastic strand to form a distinct adhesive mass on the strand. The adhesive filament movement in the opposite direction causes a momentary stretching of the adhesive filament to form the thinner filament sections. If the relative speed differential between the adhesive filament and the elastic strand is great enough during this movement in the opposite direction, then the filament will break between two consecutive adhesive masses.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein what is claimed is:

The invention claimed is:

1. A nozzle for discharging a plurality of liquid filaments onto a moving substrate, comprising:

a nozzle body having a first side and a second side, said first side including a liquid supply port and an air supply port adapted to couple with respective liquid and air supply passages of a module body, and said second side including a plurality of recesses;

a plurality of frusto-conically shaped protrusions on said second side, each said protrusion including a base positioned within one of said recesses, an apex and a side surface converging toward said apex;

a plurality of liquid discharge passages, each said liquid discharge passage extending along an axis through said apex of a respective one of said protrusions and communicating with said liquid supply port; and a plurality of air discharge passages in said nozzle body, each said air discharge passage opening into one of said recesses adjacent said base of said respective protrusion.

2. The nozzle of claim 1, wherein each of said recesses has a generally conical shape.

3. The nozzle of claim 1, wherein each of said air discharge passages is angled in a direction generally toward said respective liquid discharge passage and is offset from the axis of said liquid discharge passage.

4. The nozzle of claim 3, wherein said air discharge passages are oriented such that air issuing from each said air discharge passage is in a direction generally tangential to the direction of the liquid filament issuing from said respective liquid discharge passage.

5. The nozzle of claim 1, wherein each of said air discharge passages is offset from the axis of said respective liquid discharge passage by a distance at least equal to the radius of said liquid discharge passage.

6. The nozzle of claim 1, wherein said air discharge passages are positioned in a generally square pattern about said respective liquid discharge passages.

7. The nozzle of claim 6, wherein each of said air discharge passages is offset by the same distance from the axis of its respective liquid discharge passage.

8. The nozzle of claim 6, wherein said air discharge passages positioned at diagonally opposed corners of said square pattern are symmetrically positioned relative to said respective liquid discharge passage.

9. The nozzle of claim 6, wherein each of said air discharge passages of said square pattern is offset from the axis of said respective liquid discharge passage by a distance at least equal to the radius of said respective liquid discharge passage.

10. An applicator for dispensing a plurality of liquid filaments onto a moving substrate, comprising:

a module body;

a nozzle body coupled to said module body and having a first side and a second side, said first side including a liquid supply port and an air supply port communicating with respective liquid and air supply passages of said module body, and said second side including a plurality of recesses;

a plurality of frusto-conically shaped protrusions on said second side, each said protrusion including a base positioned within one of said recesses, an apex, and a side surface converging toward said apex;

a plurality of liquid discharge passages, each said liquid discharge passage extending along an axis through said apex of a respective one of said protrusions and communicating with said liquid supply port; and a plurality of air discharge passages in said nozzle body, each said air discharge passage opening into one of said recesses adjacent said base of said respective protrusion.

* * * * *